US010294069B2

(12) United States Patent
King

(10) Patent No.: US 10,294,069 B2
(45) Date of Patent: May 21, 2019

(54) MULTIMODAL USER INTERFACE FOR DESTINATION CALL REQUEST OF ELEVATOR SYSTEMS USING ROUTE AND CAR SELECTION METHODS

(71) Applicants: ThyssenKrupp Elevator AG, Essen (DE); ThyssenKrupp AG, Essen (DE)

(72) Inventor: Chih-Hung Aaron King, Sharpsburg, GA (US)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 471 days.

(21) Appl. No.: 15/140,936

(22) Filed: Apr. 28, 2016

(65) Prior Publication Data

US 2017/0313546 A1 Nov. 2, 2017

(51) Int. Cl.
*B66B 1/34* (2006.01)
*B66B 1/24* (2006.01)
(Continued)

(52) U.S. Cl.
CPC ..... *B66B 1/2491* (2013.01); *B66B 1/468* (2013.01); *B66B 3/006* (2013.01); *B66B 9/003* (2013.01);
(Continued)

(58) Field of Classification Search
CPC ..... B66B 1/2491; B66B 1/468; B66B 3/006; B66B 9/003; B66B 2201/103;
(Continued)

(56) References Cited

U.S. PATENT DOCUMENTS 6,868,945 B2 * 3/2005 Schuster ..... B66B 1/468 187/380
7,040,458 B2 * 5/2006 Forsythe ..... B66B 1/34 187/389
(Continued)

FOREIGN PATENT DOCUMENTS

EP 1269146 A2 1/2003
JP 201530613 A 2/2015
(Continued)

*Primary Examiner* — Anthony J Salata
(74) *Attorney, Agent, or Firm* — The Webb Law Firm

(57) ABSTRACT

An elevator control system for an elevator system, including a display device, at least one processor in communication with the display device and the elevator system, the at least one processor programmed or configured to render, on the display device, a graphical destination interface with a plurality of visual representations of destinations within the building, receive a user selection of a selected destination from the plurality of destinations, determine a plurality of selectable options for elevator call requests based on the selected destination, render the plurality of selectable options for elevator call requests on the graphical destination interface or a second graphical call request interface, receive a user selection of a selected option from the plurality of selectable options for elevator call requests, and control movement of an elevator car in the elevator system based on the selected destination and the selected option.

20 Claims, 13 Drawing Sheets

(51) Int. Cl.
*B66B 1/46* (2006.01)
*B66B 9/00* (2006.01)
*B66B 3/00* (2006.01)

(52) U.S. Cl.
CPC . *B66B 2201/103* (2013.01); *B66B 2201/4615* (2013.01); *B66B 2201/4638* (2013.01); *B66B 2201/4653* (2013.01)

(58) Field of Classification Search
CPC .... B66B 2201/4615; B66B 2201/4638; B66B 2201/4653
USPC ..... 187/247, 380–388, 391, 393, 396
See application file for complete search history.

(56) References Cited

U.S. PATENT DOCUMENTS

| | | | | |
|---|---|---|---|---|
| 7,610,995 | B2 * | 11/2009 | Ylinen | B66B 1/34 187/381 |
| 8,047,333 | B2 * | 11/2011 | Finschi | B66B 1/468 187/382 |
| 8,136,636 | B2 | 3/2012 | Bahjat et al. | |
| 8,233,008 | B2 | 7/2012 | Jin et al. | |
| 8,348,021 | B2 | 1/2013 | Finschi | |
| 9,016,440 | B2 * | 4/2015 | Finschi | B66B 1/2458 187/382 |
| 9,045,314 | B2 | 6/2015 | Finschi | |
| 9,079,749 | B2 * | 7/2015 | Hsieh | B66B 3/002 |
| 9,469,500 | B2 * | 10/2016 | Friedli | B66B 1/2408 |
| 9,561,932 | B2 * | 2/2017 | Salmikuukka | B66B 1/468 |
| 9,957,132 | B2 * | 5/2018 | Berryhill | B66B 1/468 |
| 9,998,581 | B1 * | 6/2018 | Noxon | B66B 1/468 |
| 10,017,355 | B2 * | 7/2018 | Silvennoinen | B66B 1/468 |
| 10,023,427 | B2 * | 7/2018 | Scoville | G06F 3/017 |
| 10,046,948 | B2 * | 8/2018 | Garfinkel | B66B 1/468 |
| 2005/0217946 | A1 | 10/2005 | Siikonen et al. | |
| 2008/0067013 | A1 | 3/2008 | Ylinen et al. | |
| 2014/0014444 | A1 | 1/2014 | Kauppinen et al. | |
| 2014/0245232 | A1 | 8/2014 | Bailiang | |

FOREIGN PATENT DOCUMENTS

| | | | |
|---|---|---|---|
| WO | 0165231 | A2 | 9/2001 |
| WO | 2014086691 | A1 | 6/2014 |
| WO | 2015023278 | A1 | 2/2015 |
| WO | 2016044061 | A1 | 3/2016 |

* cited by examiner

MULTIMODAL USER INTERFACE FOR DESTINATION CALL REQUEST OF ELEVATOR SYSTEMS USING ROUTE AND CAR SELECTION METHODS

BACKGROUND OF THE INVENTION

Field of the Invention

This disclosure relates to the operation of an elevator system and, more particularly, to a multimodal user interface for destination call requests of an elevator system using route and car selection methods.

Description of Related Art

Destination request or call request is an important feature of an elevator system and is often the first interaction between a user and the elevator system. Conventional elevator systems operate in a single axis so each floor stop can be represented by a simple naming convention, such as using an alpha-numeric (e.g., Floor 2 or Floor B). A multi-axis elevator system, however, offers a potential advantage of using one elevator on multiple shafts and an increase of the distance of service. Each elevator car in a multi-axis elevator system can be designed for more stops in various locations and axes in addition to each floor of a building.

These increased capabilities of the multi-axis elevator system, however, may present a challenge to the user interface of the elevator system for call requests that mainly consist of a sequence of button presses. The floor stop naming representation may become more complex for a multi-axis elevator system, and the complexity increases as the number of axes increases. For example, a floor stop of a three-axis elevator system can be located at a particular building floor (y-axis), a particular corridor (x-axis), and a particular hallway (z-axis). The multi-axis elevator system may also have a plurality of elevator floors, corridors, and hallways. An individual using the multi-axis elevator system may find it difficult and confusing to identify the desired destination from each stop's multi-axis information. For example, the individual may wish to reach Floor 6, Corridor A, and Hallway B, but may accidently or mistakenly request a call to Floor 6, Corridor B, and Hallway A.

A multi-axis elevator system may also take multiple, alternative routes to reach the same destination. As a result, there may be multiple options that an individual can choose from to reach the desired destination. A multi-axis elevator system may have multiple elevator cars and/or routes that the individual can choose from to reach his/her destination. However, current elevator control interfaces, primarily designed from single-axis, single car elevator systems, are limited in operation when used in a multi-axis, multi-route, multi-car elevator system. There is a current need in the industry for an elevator user interface that displays multiple routes and/or multiple car options to an individual and allows the individual to select the desired elevator car and/or route to his/her destination.

There are currently several challenges in designing a user interface for a multi-axis elevator system. A first challenge for designing the user interface is in determining how to display the floor/level stop to a user. A second challenge for designing the user interface is in determining how to display the options of different routes to the user and receive the user's desired choices for destination and route. A third challenge for designing the user interface is determining how to allow a user to intuitively make a call request. Using prior art methods of displaying elevator stops in an alpha-numeric representation in a multi-axis, multi-route, multi-car elevator system can be complicated and confusing to users.

SUMMARY OF THE INVENTION

In view of the foregoing, there is a current need for a user interface for an elevator system that clearly displays the stops available to a user. There is a further need for a user interface for a multi-axis, multi-car, multi-route elevator system that allows a user to intuitively choose a desired destination and/or route.

In one aspect of the disclosure, an elevator control system for a multi-axis elevator system including at least one elevator car that moves throughout a building may include a display device, at least one processor in communication with the display device and the elevator system, the at least one processor programmed or configured to render, on the display device, a graphical destination interface comprising a plurality of visual representations of destinations within the building, receive a user selection of a selected destination from the plurality of destinations, determine a plurality of selectable options for elevator call requests based on the selected destination, render the plurality of selectable options for elevator call requests on the graphical destination interface or a second graphical call request interface, receive a user selection of a selected option from the plurality of selectable options for elevator call requests, and control movement of an elevator car in the elevator system based on the selected destination and the selected option.

The elevator may be controlled by transmitting at least one control signal to at least one of the following: an elevator car controller, a master controller, a remote server, or any combination thereof. The graphical destination interface may include an isometric rendering of at least a portion of the building, the three-dimensional rendering comprising the plurality of destinations. The elevator call request options for user selection may be rendered on the second graphical call request interface. The elevator call request options may include at least two of the following: a shortest route in distance traveled to a final destination, a route with the shortest time to destination (ETD), a route that departs the quickest or has the quickest estimated time of arrival (ETA), a route with the shortest riding time, a most popular route to the final destination, a least crowded route to the final destination, a route with fewest direction changes, a route with a lowest energy consumption, a route customized for a specific building, company, individual, or group of individuals, or any combination thereof. The elevator call request options may include at least two different elevator car options for user selection. Each elevator car option may display at least one of the following: an occupancy of the elevator car, an estimated time to a final destination chosen by the user, and an estimated time of arrival for the elevator car. A gesture-based control system may be in communication with the at least one processor. The gesture-based control system may be configured to permit the user to select the elevator call request based on gestures made by the user. The gesture-based control system may include at least one motion sensor configured to track the gestures made by the user. The motion sensor may track the gestures made by the user based on the motion of a wearable device worn by the user relative to the motion sensor. A vision-based control system may be in communication with the at least one processor. The vision-based control system may be configured to permit the user to select the elevator call request based on motions made by the user. The vision-based control system may include one of the following to track the gestures made by the user: a stereo camera, a proximity sensor, and an infrared depth sensor.

In another aspect of the disclosure, a computer-implemented method for controlling an elevator car in a multi-axis elevator system that permits movement of the elevator car throughout a building may include rendering, on a display device, a graphical destination interface comprising a visual representation of at least a portion of the elevator system including a plurality of destinations within the building, receiving, from an input device, a selected destination from the plurality of destinations, determining, with at least one processor, a plurality of route options or elevator car options available for a user to choose from, rendering, on the display device, the plurality of route options or elevator car options, receiving, from the input device, a selected route option or elevator car option from the plurality of route options or elevator car options, and controlling, with at least one processor, movement of the elevator car based on the selected route option or elevator car option.

The route options or elevator car options for user selection may be displayed on the graphical destination interface or a graphical call request interface. The route options may include at least two of the following: a shortest route in distance traveled to a final destination, a route with the shortest time to destination (ETD), a route that departs the quickest or has the quickest estimated time of arrival (ETA), a route with the shortest riding time, a most popular route to the final destination, a least crowded route to the final destination, a route with fewest direction changes, a route with a lowest energy consumption, a route customized for a specific building, company, individual, or group of individuals, or any combination thereof. Each elevator car option may display at least one of the following: an occupancy of the elevator car, an estimated time to a final destination for the elevator car or route (ETD), an estimated time of arrival for the elevator car, or any combination thereof. One of the route options or the elevator car options may be selected by a gesture made by a user. The visual representation of at least a portion of the elevator system may be manipulated by the user to allow the user to select the destination from the plurality of destinations. The user may manipulate the visual representation of at least a portion of the elevator system using one of the following: gestures made in front of the display device, pinching the visual representation, pressing the visual representation, tapping the visual representation, or any combination thereof.

In another aspect of the disclosure, a computer program product for controlling a multi-axis elevator system that permits movement of at least one elevator car throughout a building, may include at least one non-transitory computer-readable medium including program instructions that, when executed by at least one processor, may cause the at least one processor to render, on a display device, a graphical destination interface comprising a visual representation of at least a portion of the elevator system including a plurality of destinations within the building, receive, from an input device, a selected destination from the plurality of destinations, determine, with at least one processor, a plurality of route options or elevator car options available for a user to choose from, render, on the display device, the plurality of route options or elevator car options, receive, from the input device, a selected route option or elevator car option from the plurality of route options or elevator car options, and control, with at least one processor, movement of the elevator car based on the selected route option or elevator car option.

These and other features and characteristics of the user interface and elevator system, as well as the methods of operation and functions of the related elements of the system, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DESCRIPTION OF THE DISCLOSURE

Figure 1:
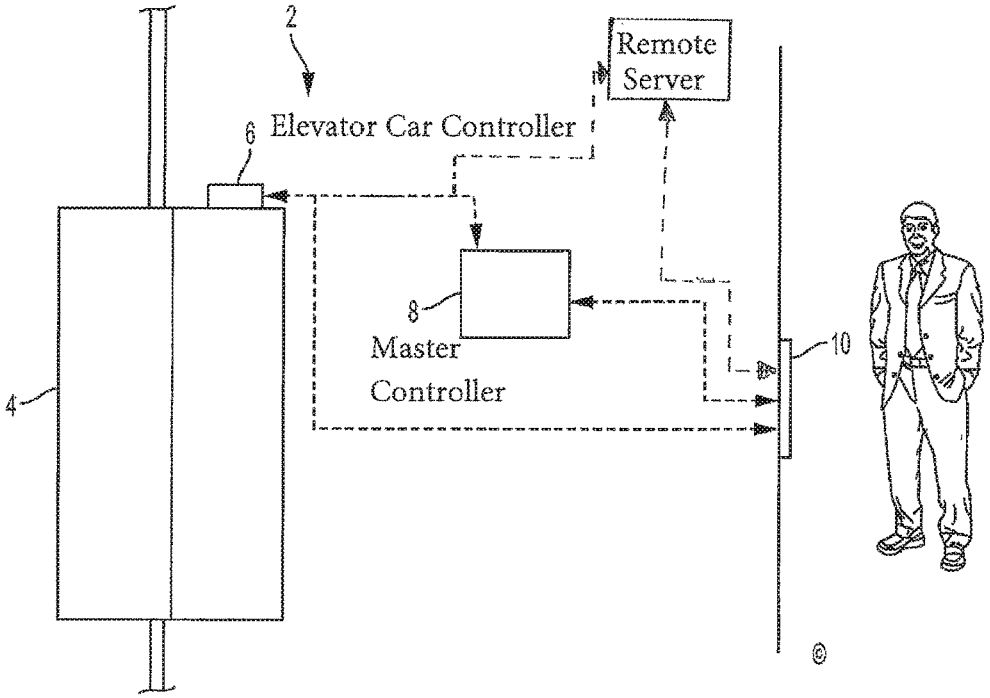
FIG. 1 is a schematic diagram of an elevator control system according to the present disclosure.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

For purposes of the description hereinafter, the terms "upper", "lower", "right", "left", "vertical", "horizontal", "top", "bottom", "lateral", "longitudinal", and derivatives thereof, shall relate to the invention as it is oriented in the figures. However, it is to be understood that the invention may assume alternative variations and step sequences, except where expressly specified to the contrary. It is also to be understood that the specific systems and processes illustrated in the attached drawings, and described in the following specification, are simply exemplary aspects of the invention. Hence, specific dimensions and other physical characteristics related to the aspects disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, encrypted, processed, routed, etc., between the first and second unit or device. It will be appreciated that numerous arrangements are possible. Any known electronic communication protocols and/or algorithms may be used such as, for example, UDP, TCP/IP (including HTTP and other protocols), WLAN (including 802.11 and other radio frequency-based protocols and methods), analog transmissions, cellular networks, and/or the like.

Referring to the drawings in which like reference numerals refer to like parts throughout the several views thereof, the present disclosure is generally directed to a user interface and control system for an elevator system and, more particularly, to a multimodal user interface for destination call requests of a multi-axis elevator system using route and car selection methods.

Referring to FIG. 1, an elevator control system 2 is described. The elevator control system 2 is shown with a single elevator car 4. In one aspect, the elevator control system 2 may include multiple elevator cars. The elevator car 4 may move through a building in a vertical direction (y-axis), a left-right direction (x-axis), a front-rear direction (z-axis), or any multi-dimensional direction vector within the building. The elevator car 4 may move through the building using any method that is known in the art or future-developed for moving an elevator car in an elevator system. An elevator car controller 6 may be provided on the elevator car 4. The elevator car controller 6 may be used to communicate with other components of the elevator control system 2. In one aspect, the elevator car controller 6 may be a controller that is part of a control panel, such as a microprocessor, a microcontroller, a central processing unit (CPU), and/or any other type of computing device. However, additional control systems or components that direct information through signals to other control systems may also be used for the elevator car controller 6. The elevator car controller 6 may be in wireless communication with a master controller 8. The master controller 8 may receive information from the elevator car controller 6 regarding the current position of the elevator car 4 and/or the travel rate of the elevator car 4, among other information regarding the elevator car 4. In one aspect, the master controller 8 may be a controller that is part of a control panel, such as a microprocessor, a microcontroller, a CPU, and/or any other type of computing device. The master controller 8 may be in wireless communication with each separate elevator car included in the elevator system. It is also contemplated that the master controller 8 may be the elevator car controller 6 or may be housed in one of the elevator cars 4 of the elevator system. The master controller 8 may be in wired and/or wireless communication with at least one user interface 10 provided at one or more of a plurality of loading stations within the building for users to enter and exit the elevator car 4. In one aspect, the user interface 10 may be a control panel or similar display that allows a user to select a desired destination and route within the building. The user interface 10 may include a CPU or other controller in wireless communication with the master controller 8. Information from the master controller 8 regarding the elevator car 4 may be received by the user interface 10. It is also contemplated that each elevator car controller 6 may be in wireless communication with the user interface 10. Each elevator car controller 6 may transmit information regarding the elevator car 4 directly to the user interface 10.

Figure 2:
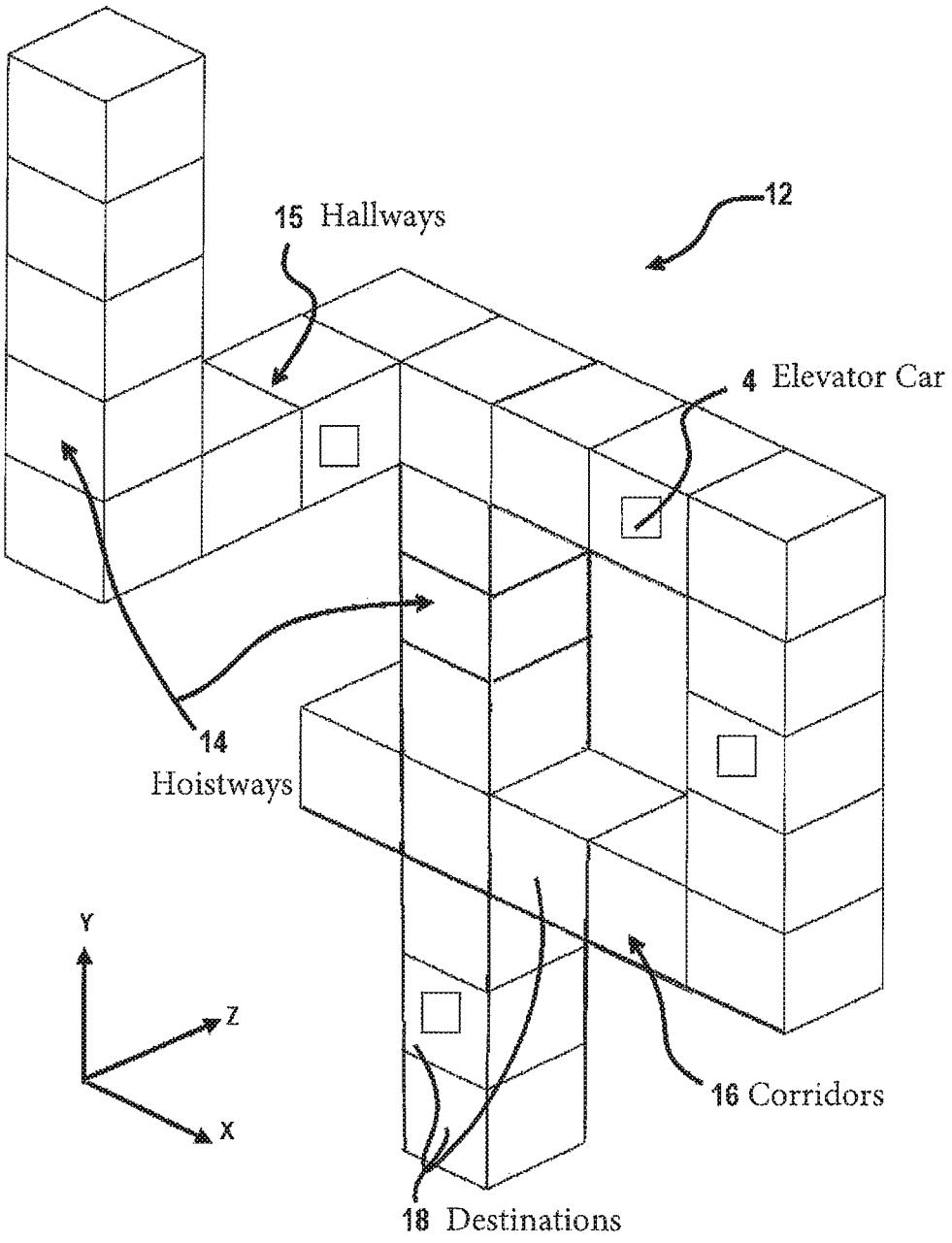
FIG. 2 is a perspective view of a multi-axis elevator system in a building according to the present disclosure.

With reference to FIG. 2, a multi-axis, multi-car, multi-route elevator system 12 is shown and described. In one aspect, the elevator system 12 may include at least two elevator cars 4. It is also contemplated that additional elevator cars may be added to the elevator system 12 to handle a high traffic demand. The elevator system 12 may include multiple hoistways 14, hallways 15, and corridors 16. The hoistways 14 are understood to be passageways in the elevator system 12 through which the elevator cars 4 are configured to travel in a vertical direction. The hallways 15 and the corridors 16 are understood to be passageways in the elevator system 12 through which the elevator cars 4 move in either a left-right direction or a front-rear direction. In one aspect, the elevator system 12 may include a plurality of different destinations 18 from which a user may pick to move through the building.

Figure 3:
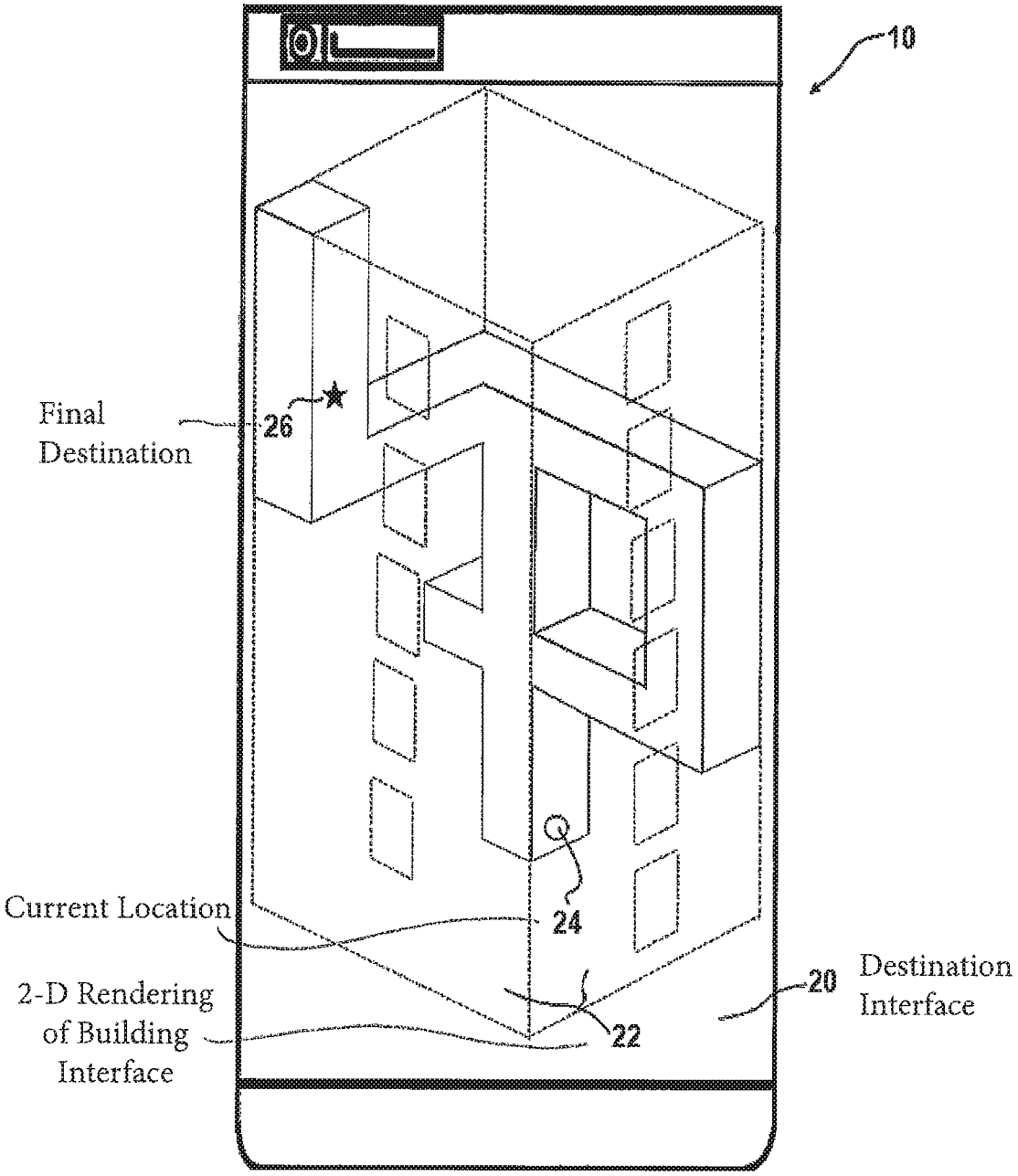
FIG. 3 is an illustration of a user interface showing destination options in a building according to the present disclosure.

With reference to FIGS. 3-6, the user interface 10 and operation of the user interface 10 to request an elevator route is shown and described. As shown in FIG. 3, the user interface 10, which may be provided in an elevator lobby, in an elevator car 4, or on a personal user device, generates and displays a graphical destination interface 20 that displays a three-dimensional, isometric, or 2-dimensional rendering of a building 22 and elevator system 12. The building portion of the rendering may be semi-transparent or selectively cutaway so that the elevator system portion of the rendering is visible. In an alternative aspect, the rendering only includes the elevator system 12. The user interface 10 generates and displays the destination interface 20. The user interface 10 may be provided on a car operating panel (COP), provided on a kiosk, provided as an application on a user's personal communication or wearable device, or provided as an image projection accompanied by a plurality of sensors. The user interface 10 may be any type of display device, such as but not limited to a liquid crystal display (LCD), plasma display, a wearable display device, a heads-up display, an implanted visual device, or an image projection onto a surface; the display device may be a touchscreen and/or paired with an input device, such as a keypad, an array of buttons, force touch sensors, optical sensors, infrared sensors, gesture recognition systems, brain-machine interfaces, or any combination thereof. In one aspect, the rendering of the building 22 and elevator system 12 includes visual representations of a plurality of destinations 18 throughout the elevator system 12 that the user can choose from to move through the building 22. In one aspect, the destination interface 20 may also display a visual representation of a current location 24 of the user within the building 22. The visual representations may include, for example, icons, animation, graphics, text boxes, and/or the like. The user can manipulate the destination interface 20 through the touchscreen and/or associated input device to navigate, search, and select a desired final destination 26 through the graphical environment of the destination interface 20. In one aspect, the user can navigate, search, and select the desired final destination 26 in the destination interface 20 in real time as the elevator cars 4 are moving through the elevator system 12. Methods of selecting the final destination 26 on the destination interface 20 are described in greater detail below.

Figure 4:
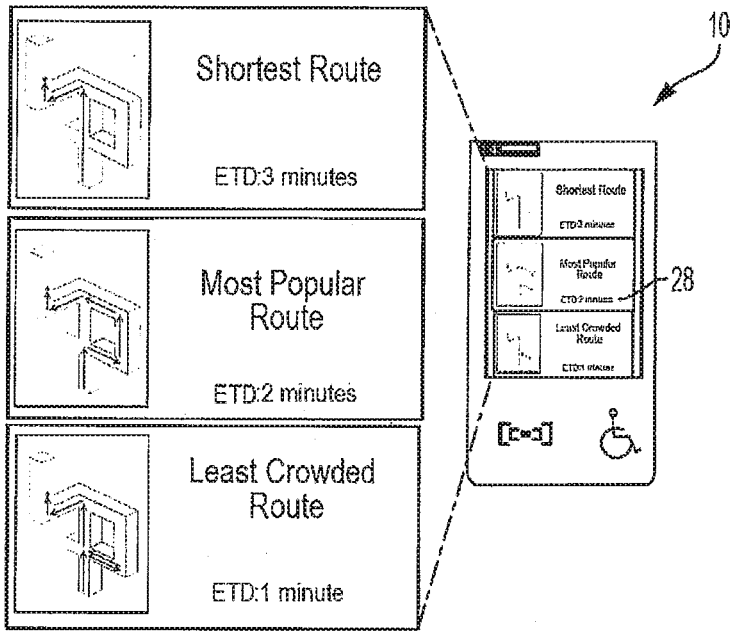
FIG. 4 is an illustration of the user interface of FIG. 3 displaying route options for user selection.

As shown in FIG. 4, after the desired final destination 26 has been chosen by the user, the user interface 10 may switch from the destination interface 20 to a graphical call request interface 28 that may display a plurality of route options to allow the user to select the desired option for reaching his/her final destination 26. It is to be understood that the destination interface 20 and the call request interface 28 may be part of the same interface or may be separate independent interfaces. In one aspect, the call request interface 28 may directly connect to or interface with a destination dispatch engine (not shown) in the elevator car controller 6 or remote controller. In another aspect, the call request interface 28 may indirectly connect to or interface with the destination dispatch engine of the elevator car controller 6 through the master controller 8 of the elevator control system 2. The destination dispatch engine of the elevator car controller 6 may include one or more software programs or routines executed by one or more controllers, and may process information received from the user interface 10 according to one or more algorithms. The destination dispatch engine may include program instructions stored on one or more computer-readable media that are executable by one or more controllers to perform one or more processes. It will be appreciated that the computer-readable media may include a separate memory device, remote server, and/or a memory space of a controller, as examples. The elevator car controller 6 may record data pertaining to the position and route of the elevator car 4. The elevator car controller 6 or, alternatively, the master controller 8 may provide information to the user interface 10, such as a shortest route in distance traveled to a final destination, a route with the shortest time to destination (ETD), a route that departs the quickest or has the quickest estimated time of arrival (ETA), a route with the shortest riding time, a most popular route to the final destination, a least crowded route to the final destination, a route with fewest direction changes, a route with the lowest energy consumption, or any combination thereof. In other aspects, the elevator call requests or route request options may further include a route customized for a specific building, company, individual, or group of individuals. In yet another aspect, each elevator car or route option may display at least one of the following: an occupancy of the elevator car, an estimated time to a final destination for the elevator car or route (ETD), and an estimated time of arrival for the elevator car.

As shown in FIG. 4, the call request interface 28 may display this route information to the user. In one aspect, the call request interface 28 may display the shortest route to the final destination 26, the most popular route to the final destination 26, and/or the least crowded route to the final destination 26 based on the number of other users that will be assigned to the elevator car 4 along the route. It is contemplated that the call request interface 28 may display any number of route options to the user. In one aspect, the call request interface 28 displays three route options to the user. In another aspect, the call request interface 28 may include a plurality of route options that the user can scroll or otherwise navigate through to determine the desired option for requesting the elevator route. A technician or building management personnel may determine the order of displaying the route list on the call request interface 28 by selecting one or more parameters for ranking the routes, including estimated time of arrival, estimated time to the selected final destination 26, total wait time for the elevator car 4 to arrive at the user's location, and/or the popularity/frequency of usage for a particular route. In some aspects, a technician or building management personnel may schedule lock outs of certain route options during a certain time of day or week or for a special event, etc. A user may also select one or more parameters for ranking the routes. The call request interface 28 may highlight the specific route for each route option to inform the user of the specific route along which the elevator car 4 will travel. In one aspect, the highlighted route or the highlighted route in combination with a rendering of the building 22 and/or the elevator system 12 may be depicted next to the specific route option. In some aspects, adjacent each specific route option, the call request interface 28 may display an estimated time to destination (ETD) for the elevator car 4 to arrive at the user's final destination for each route option.

Figure 5:
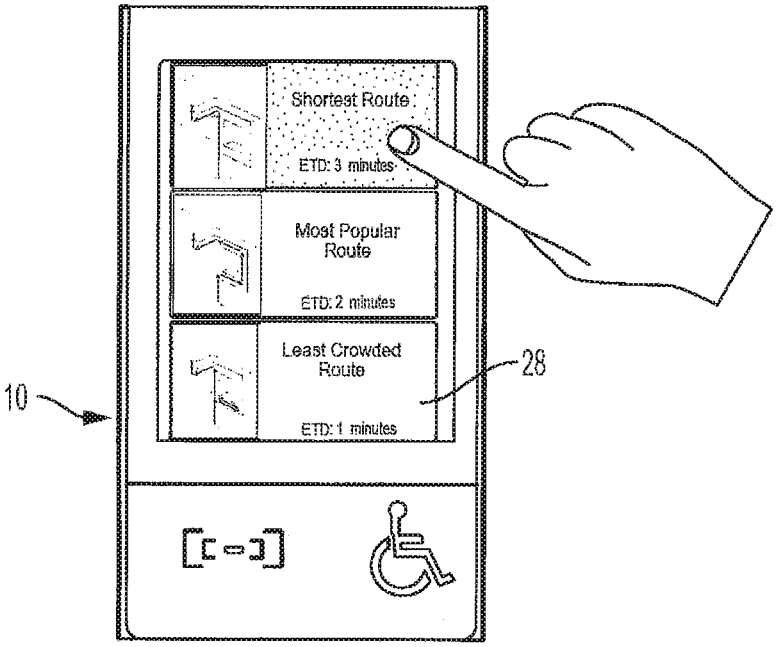
FIG. 5 is an illustration of a user selecting a desired route option on the user interface of FIG. 3.
Figure 6:
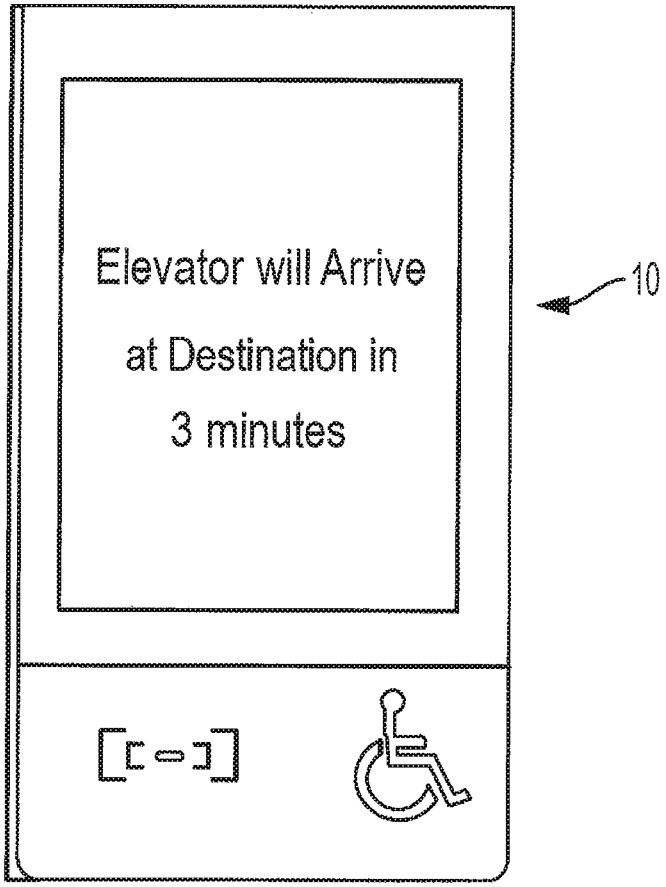
FIG. 6 is an illustration of information provided on the user interface of FIG. 3 given after a user has selected a desired route option.

As shown in FIG. 5, once the user has determined the desired route to choose for the elevator route request call, the user may select the desired route on the call request interface 28. The particular methods of selecting the desired route option on the call request interface 28 are described in greater detail below. Once the route option has been selected, the user interface 10 will communicate a signal to the elevator car controller 6 directly or, alternatively, indirectly through the master controller 8, to request the elevator car 4. As shown in FIG. 6, after the signal has been sent to the elevator car controller 6, the destination interface 20 on the user interface 10 will display specific information regarding the specific route. This specific information may include an updated estimated time to destination (ETD). In one aspect, the destination interface 20 may display the rendering of the visual representation(s) of the building 22 and the elevator system 12 to show the movement of the elevator car 4 through the elevator system 12.

Figure 7:
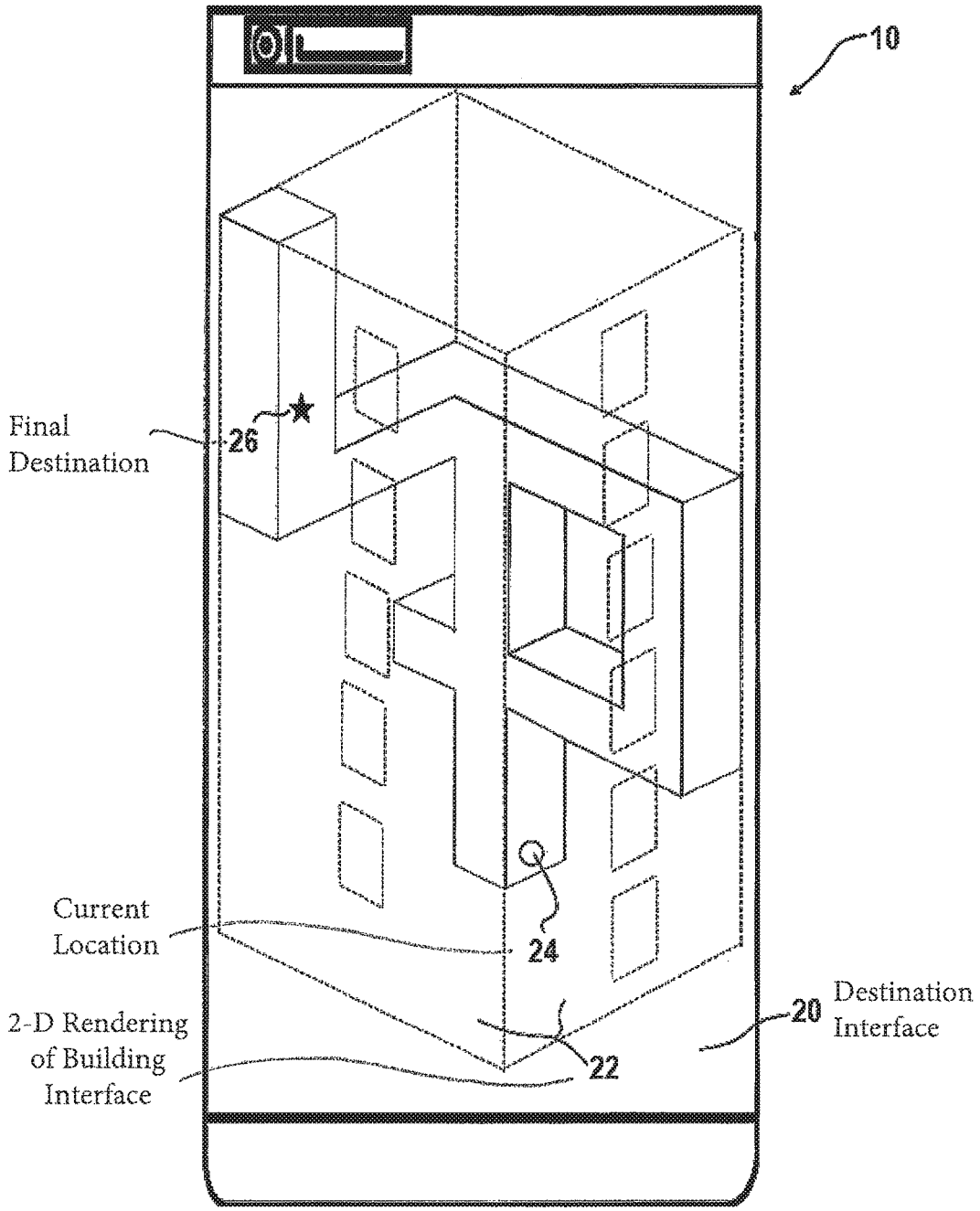
FIG. 7 is an illustration of a user interface showing destination options using a user interface according to another aspect of the disclosure.

With reference to FIGS. 7-10, in another aspect, an operation of the user interface 10 to request an elevator car is shown and described. As shown in FIG. 7, in this aspect, the rendering of visual representations(s) of the building 22 and/or elevator system 12 may include a plurality of visual representations of destinations 18 (see FIG. 2) throughout the elevator system 12 that the user can choose from to move through the building 22. In one aspect, the destination interface 20 may display a visual representation of a current location 24 of the user within the building 22. The user can manipulate the destination interface 20 to navigate, search, and select a desired final destination 26 through the graphical reality environment of the destination interface 20. In one aspect, the user can navigate, search, and select the desired final destination 26 in the destination interface 20 in real time. Once the user has determined the desired final destination 26, the user can select the final destination 26 on the destination interface 20. Methods of selecting the final destination 26 on the destination interface 20 are described in greater detail below.

Figure 8:
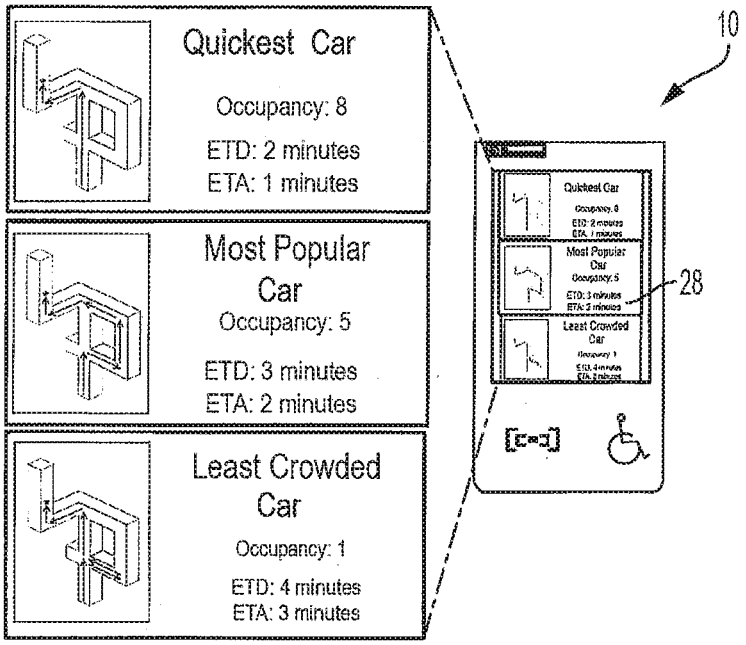
FIG. 8 is an illustration of the user interface of FIG. 7 displaying elevator car options for user selection.

As shown in FIG. 8, after the desired final destination 26 has been chosen by the user, the user interface 10 may switch from the destination interface 20 to a call request interface 28 that may display a plurality of elevator cars 4 to choose from to allow the user to select the desired option for reaching his/her final destination 26. In one aspect, the call request interface 28 may directly connect to or interface with a destination dispatch engine (not shown) in the elevator car controller 6. In another aspect, the call request interface 28 may indirectly connect to or interface with the destination dispatch engine of the elevator car controller 6 through the master controller 8 of the elevator control system 2. The elevator car controller 6 or, alternatively, the master controller 8 may provide information to the user interface 10, such as a shortest route in distance traveled to a final destination, a route with the shortest time to destination (ETD), a route that departs the quickest or has the quickest estimated time of arrival (ETA), a route with the shortest riding time, a most popular route to the final destination, a least crowded route to the final destination, a route with fewest direction changes, a route with the lowest energy consumption, or any combination thereof. In other aspects, the elevator call requests or route request options may further include a route customized for a specific building, company, individual, or group of individuals. In yet another aspect, each elevator car or route option may display at least one of the following: an occupancy of the elevator car, an estimated time to a final destination for the elevator car or route (ETD), and an estimated time of arrival for the elevator car.

The call request interface 28 may display several elevator car 4 options that the user can choose from depending on the user's desired path of travel on the elevator car 4 through the building 22. The call request interface 28 may display a plurality of elevator car 4 options for the user to choose from. In one aspect, the call request interface 28 may display three elevator car 4 options for the user to choose from. It is to be understood, however, that fewer or additional elevator car 4 options may be displayed to the user on the call request interface 28. In another aspect, the call request interface 28 may display a plurality of elevator car 4 options that the user can scroll or otherwise navigate through to determine which elevator car 4 the user would like to travel in. Each elevator car 4 option may display information regarding each elevator car 4 in the elevator system 12. In one aspect, the elevator car 4 options may display the current occupancy of the elevator car 4 and/or the occupancy of the elevator car 4 when the elevator car 4 arrives at the user's location, and/or the projected maximum occupancy of the elevator car 4 for the duration of the passenger's ride. In another aspect, the elevator car 4 options may display the estimated time to the selected final destination 26 based on the current location of the elevator car 4. In another aspect, the elevator car 4 options may display the estimated time of arrival for the selected elevator car 4. It is also contemplated that the elevator car 4 options may display all of this information, including the occupancy of the elevator car 4, the estimated time to the selected final destination 26 for the elevator car 4, and the estimated time of arrival for the elevator car 4. In another aspect, the rendering of the visual representation(s) of the building 22 and the elevator system 12 may show visual representations of each particular elevator car 4 highlighted at its current location in the building 22. In another aspect, the call request interface 28 may display elevator car 4 options as well as renderings of route options, which were previously described in detail above.

Figure 9:
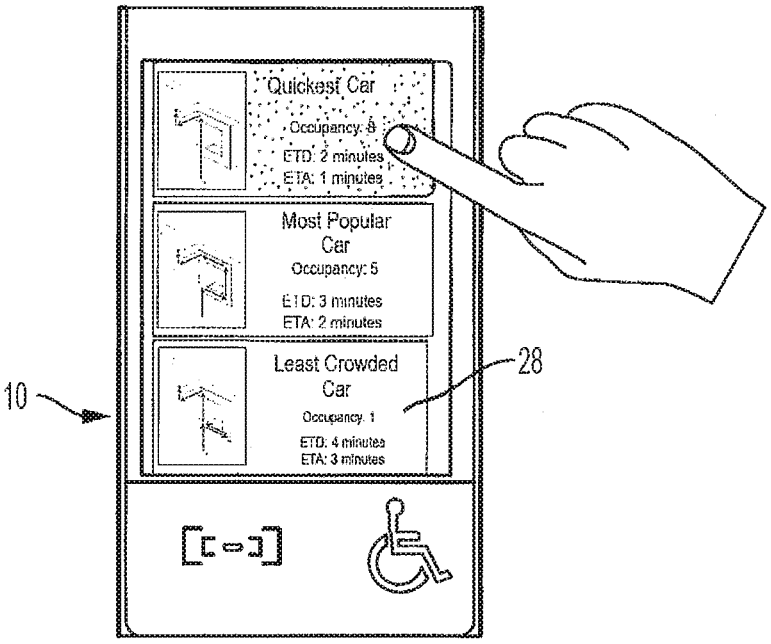
FIG. 9 is an illustration of a user selecting a desired elevator car option on the user interface of FIG. 7.
Figure 10:
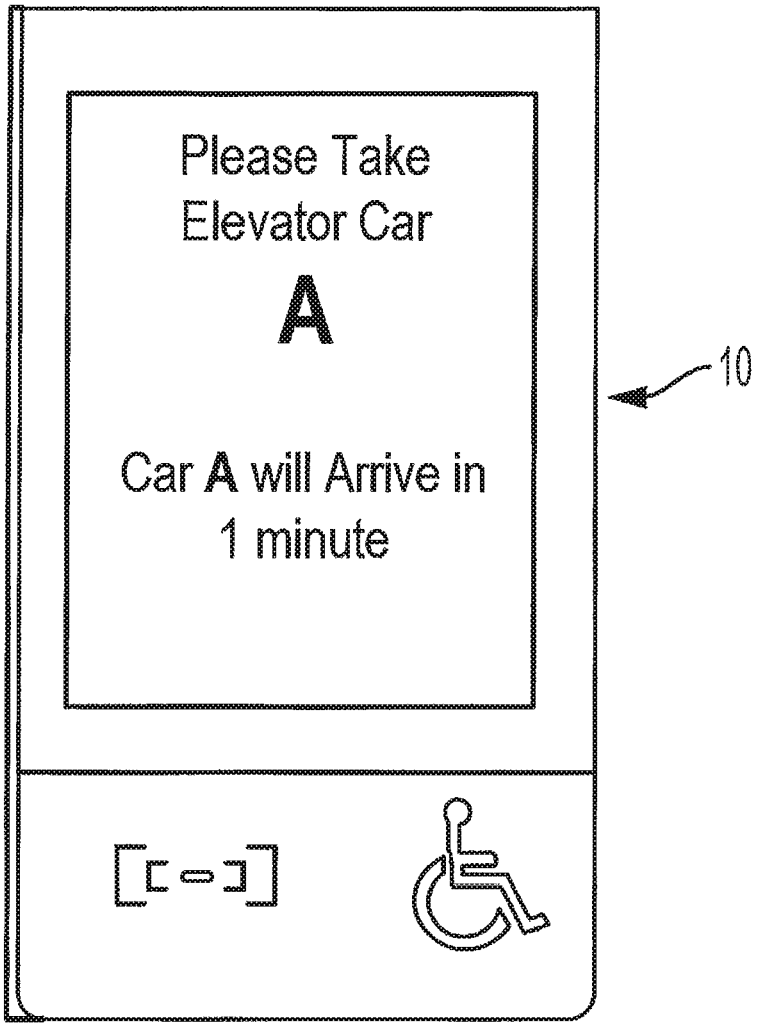
FIG. 10 is an illustration of information provided on the user interface of FIG. 7 given after a user has selected a desired elevator car option.

As shown in FIG. 9, once the user has determined the desired elevator car 4 to choose for the elevator car 4 request call, the user may select the desired elevator car 4 option on the call request interface 28. The particular methods of selecting the desired elevator car 4 option on the call request interface 28 are described in greater detail below. Once the elevator car 4 option has been selected, the user interface 10 will send a signal to the elevator car controller 6 directly or, alternatively, indirectly through the master controller 8, to request the elevator car 4. As shown in FIG. 10, after the signal has been sent to the elevator car controller 6, the destination interface 20 on the user interface 10 will display specific information regarding the elevator car 4 to the user, including the designation for elevator car 4 the passenger is assigned to and the estimated arrival time or the estimated wait time until the elevator car 4 arrives at the user's location. In one aspect, the destination interface 20 may display the rendering of the building 22 and the elevator system 12 to show the movement of the elevator car 4 through the elevator system 12. This tracking method allows the user to monitor the current location of the requested elevator car 4 in relation to the user's location in the building 22.

With reference to FIGS. 11-16, methods of selecting final destinations 26 and route/elevator car 4 options on the user interface 10 are shown and described. The user interface 10 may incorporate touch-based and/or gesture-based input systems. A user can use his fingers, hands, or limbs to manipulate the three-dimensional rendering of the visual representation(s) of the building 22 and/or the elevator system 12 to provide call requests to the elevator cars 4. In one aspect, the user can press and touch the user interface 10 to make his/her selection of the desired final destination 26 and route/elevator car 4 option. Any touch-based input technology generally known in the art may be used with the user interface 10. In another aspect, the user can use specific gestures to manipulate and input commands to the user interface 10 to make his/her selection of the desired final destination 26 and route/elevator car 4 option. Any gesture-based input technology generally known in the art may be used with the user interface 10. By using the gesture-based input technology, a touchless functionality for accessing floor information is provided to the user interface 10, which reduces the investment in hardware and software for the elevator system 12. It is also contemplated that a touch-based input system and a gesture-based input system may both be used in the user interface 10. It will be appreciated that other input devices and/or systems may be used, such as, but not limited to, one or more keypads or button arrays.

Figure 11:
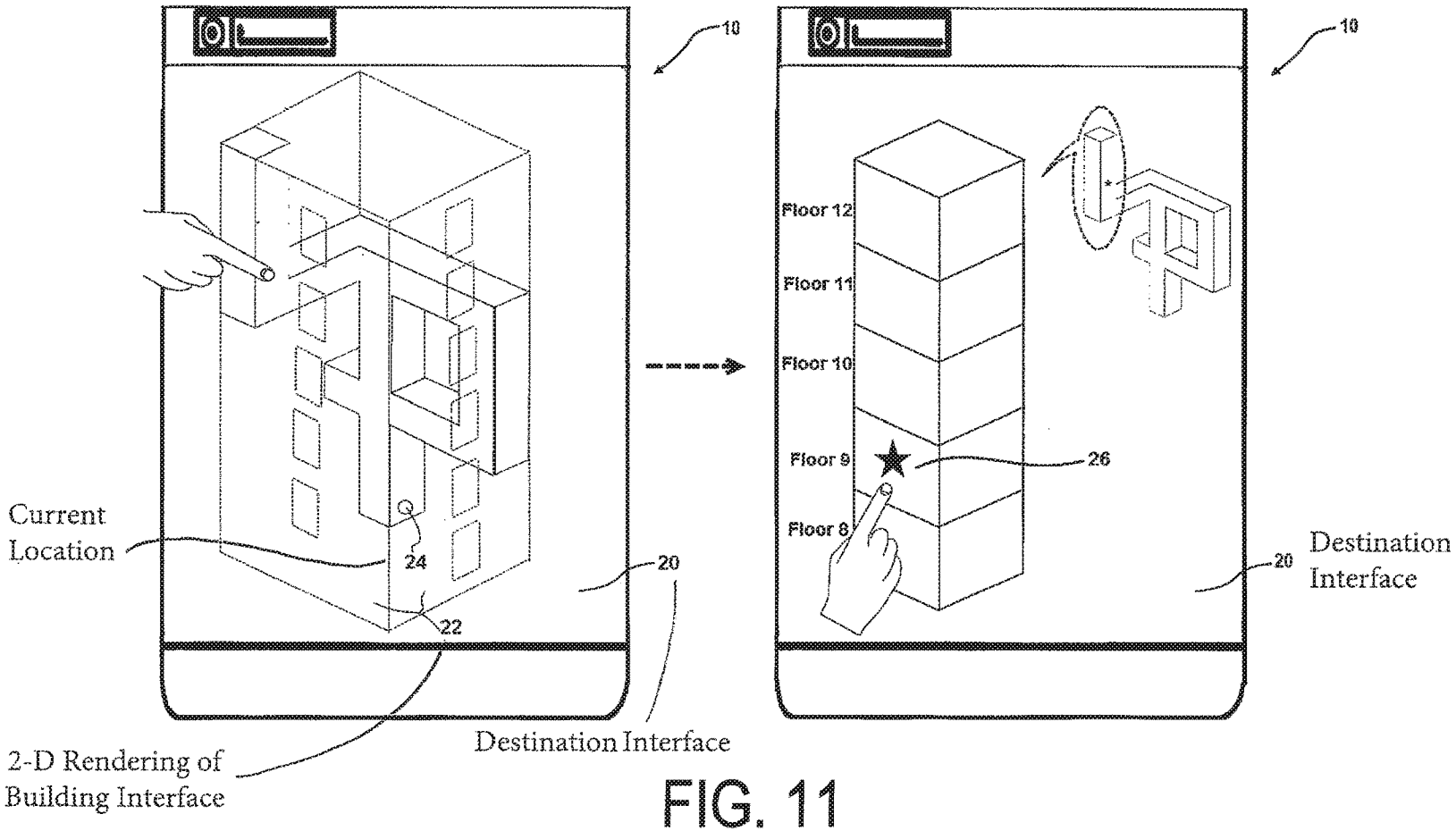
FIG. 11 is an illustration of a user interface showing destination options and a destination selection method according to an aspect of the present disclosure.
Figure 12:
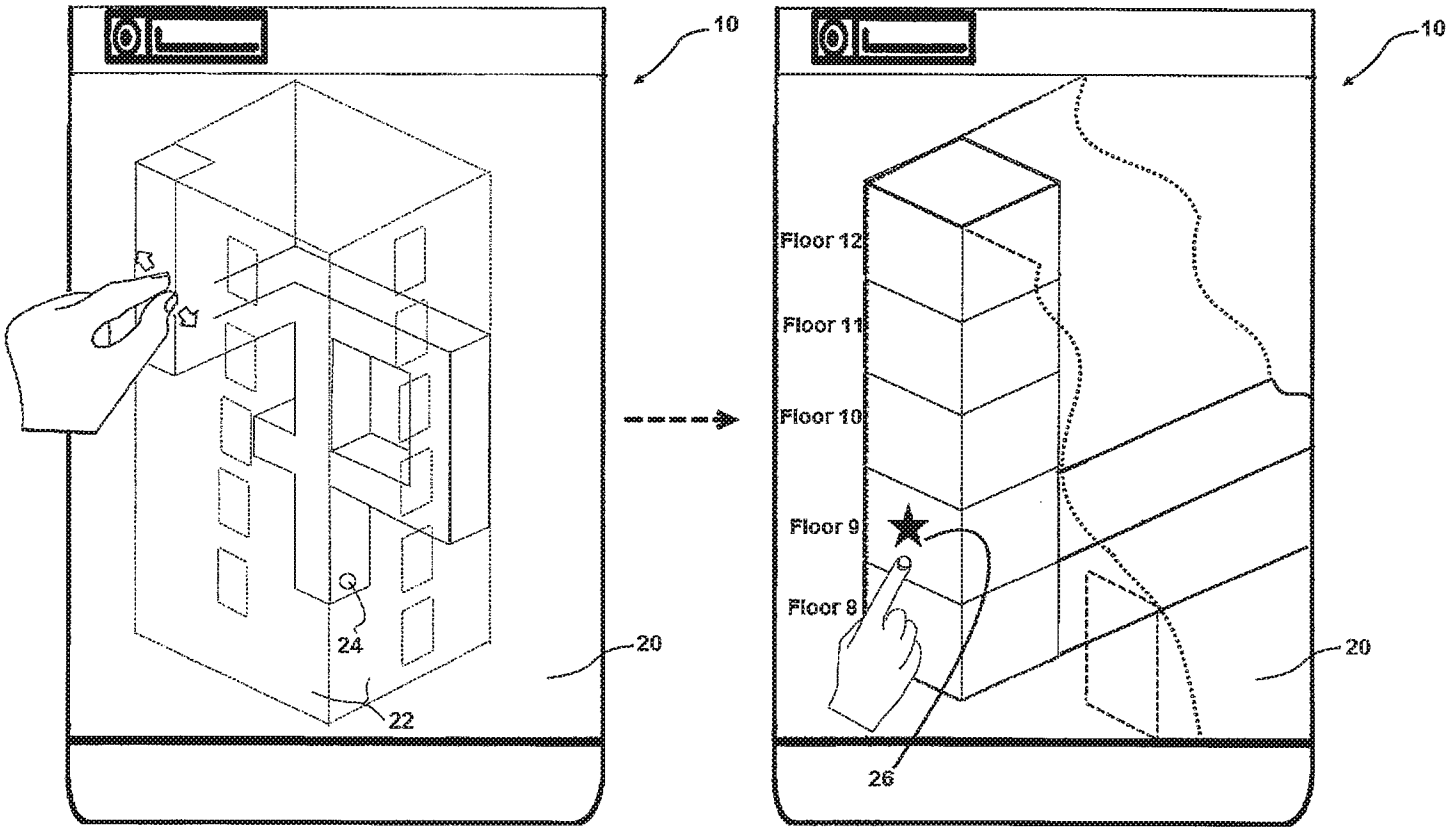
FIG. 12 is an illustration of a user interface showing destination options and a destination selection method according to another aspect of the present disclosure.
Figure 13:
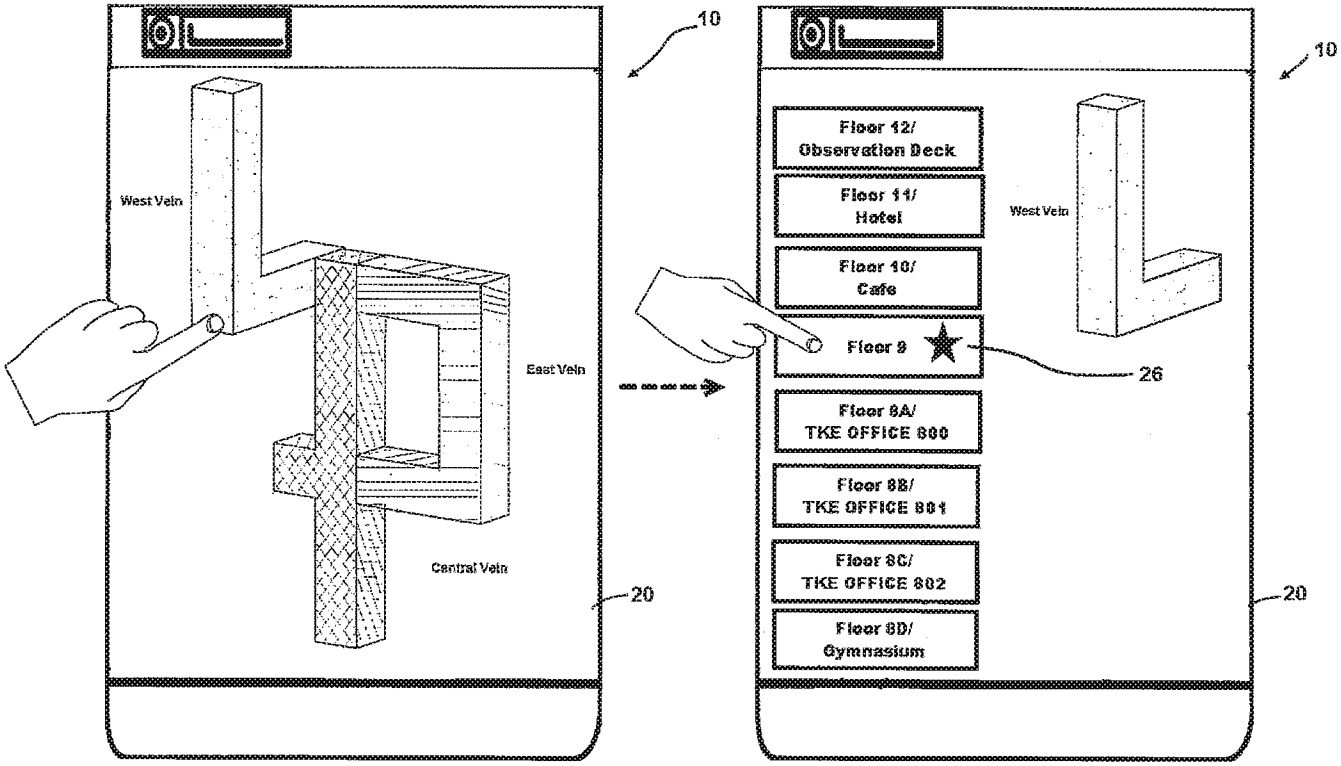
FIG. 13 is an illustration of a user interface showing destination options and a destination selection method according to yet another aspect of the present disclosure.

As shown in FIGS. 11-13, the user interface 10 may incorporate an isometric rendering of the elevator system 12 and, optionally, the building 22. The user may use fingers, hands, or limbs to manipulate the renderings on the graphical destination interface 20 by touch-based input or by gesture-based input. In one aspect, a user may select a general vicinity in which his or her desired final destination is located. A detailed rendering may then be generated and displayed on the graphical destination interface 20. This detailed rendering may be a zoomed in view of a portion of the elevator system 12 (and optionally a portion of the building 22) that is in the general vicinity of the user's previous selection. The detailed rendering may include details about all the possible destinations 18 within the portion of the elevator system 12. These details may include one or more of the following: a floor designation (e.g. 1,2,3), a hallway designation, a corridor designation, and a location/office/business name (e.g. Lobby, Office Number, Company Name) associated with the destination(s) 18. The user can select his or desired final destination 26 from this detailed rendering. In one aspect, the rendering of the elevator system 12 may be color coded or shaded to designate different regions of the elevator system 12. The user may easily identify his or her desired region by color or shading pattern. Once the user selects his or her desired region, a detailed rendering will then be generated and displayed on the graphical destination interface 20. In one aspect, the user can manipulate the graphical destination interface 20 to rotate the orientation of the isometric rendering. The user may manipulate the graphical destination interface 20 using gesture made in front of the graphical destination interface 20, pinching the graphical destination interface 20, pressing the graphical destination interface 20, tapping the graphical destination interface 20, or any combination thereof. In another aspect, the user can manipulate the graphical destination interface to zoom in to a detailed rendering of the elevator system 12 without making any initial selection. It is also contemplated that the rendering of the elevator system 12 may be 2-dimensional or 3-dimensional.

Figure 14:
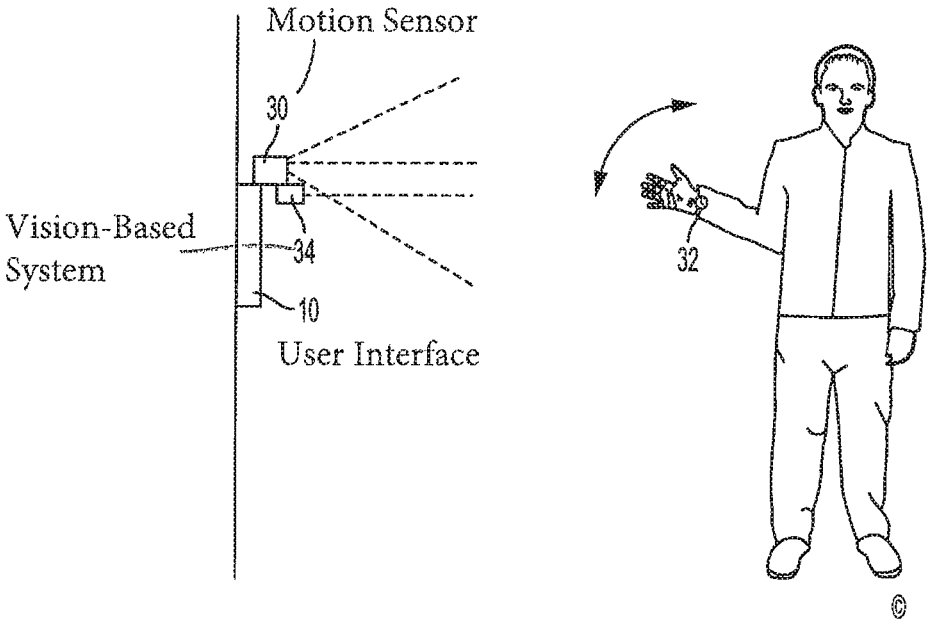
FIG. 14 is a schematic diagram of a motion-based and gesture-based control system for operating the user interface of the present disclosure.
Figure 15:
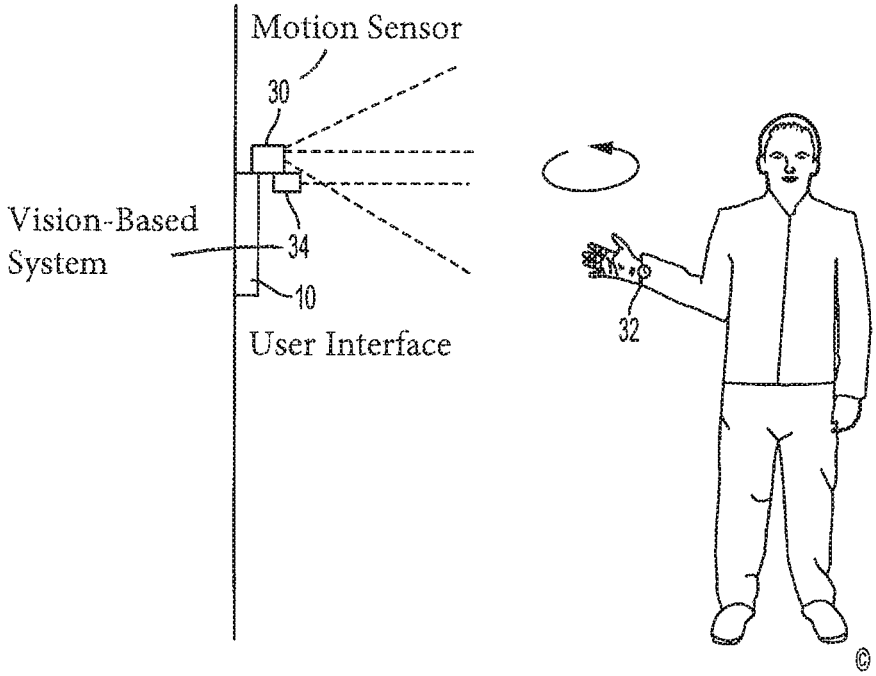
FIG. 15 is a schematic diagram of the motion-based and gesture-based control system of FIG. 14 showing a user using motion and gestures to operate the user interface.
Figure 16:
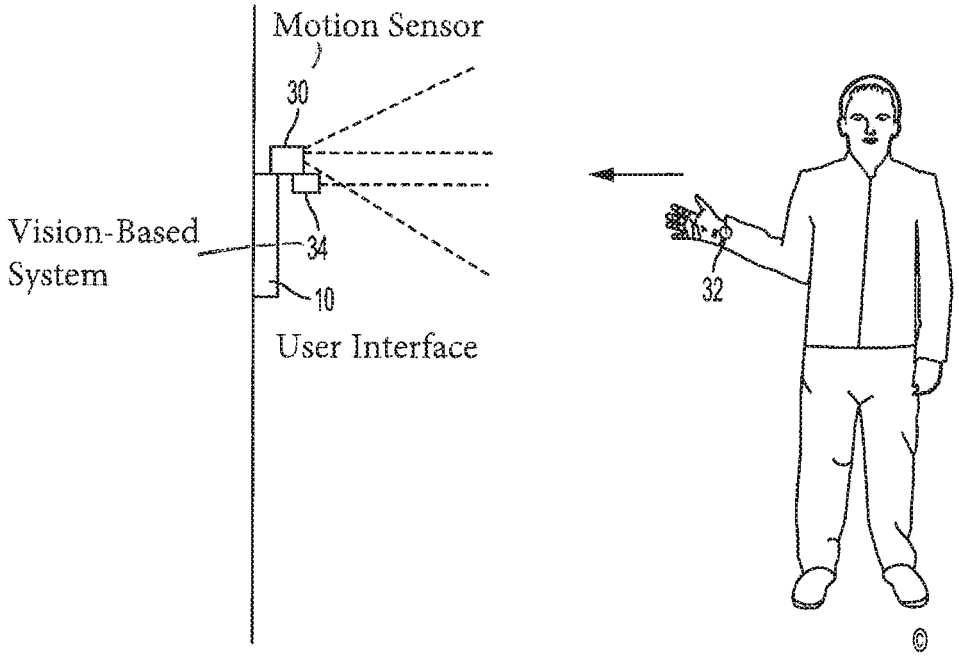
FIG. 16 is a schematic diagram of the motion-based and gesture-based control system of FIG. 14 showing a user using motion and gestures to select a desired option on the user interface.

As shown in FIGS. 14 and 15, the gesture recognition of the user interface 10 may be implemented through the use of gesture-based control systems, including wearable devices and integrated vision systems, among others. In one aspect, the gesture-based control system may be based on wearable devices 30 that are worn or carried by the user. The wearable device 30 may be a smart phone, a smart watch, a glove, implantable devices, or an arm band, among other wearable devices capable of providing gesture-based control to the user interface 10. The wearable device 30 may be recognized by or communicate with a motion sensor 32 provided on or near the user interface 10 to provide user gesture information to the user interface 10. The motion sensor 32 may use force sensors, gyroscopes, accelerometers, or electromyography, among other motion sensor technologies, to track the motion of the user's wearable device 30. As shown in FIG. 14, in one aspect, the user may initialize the gesture-based control of the user interface 10 by waving his/her hand or arm in front of the motion sensor 30. As the user moves his/her limbs and, therewith, the wearable device 32, the user interface 10 may be manipulated to move, rotate, and/or zoom in/out on the three-dimensional, isometric, or two-dimensional rendering of the visual representation(s) of the building 22 and the elevator system 12, and/or select the desired route/elevator car 4 option for an elevator call request. An elevator call request may be a selection made by the user or a signal sent from the user interface 10 that requests an elevator car be sent to the user. As shown in FIG. 15, for example, the user may move his/her hand or arm to the left to move the rendering of the user interface 10 to the left, or the user may move his/her hand or arm in an upward direction to move the rendering of the user interface 10 upward. As shown in FIG. 16, after the user has determined the desired final destination 26 and the preferred route/elevator car 4 option, the user may move his/her hand or arm towards the user interface 10 to select a desired final destination 26 or route/elevator car 4 option.

As shown in FIGS. 14-16, in another aspect of the disclosure, a vision-based system 34 may be integrated with the user interface 10 to capture the user's gestures. The vision-based system 34 may be provided in place of the motion sensor 30 or may be used together with the motion sensor 30 in the user interface 10. The vision-based system 34 may include a stereo camera, a proximity sensor, and/or an infrared depth sensor that captures real-time depth information from the user. By using the vision-based system 34, the need for wearable devices 32 is eliminated. In another aspect, the user interface 10 may include user voice recognition software that is capable of registering and operating the user interface 10 based on commands spoken by the user.

By using gesture-based systems in the user interface 10, a cost effective user interface 10 is provided that can be installed easier than installing a large wire touch screen panel and/or multiple physical buttons that are used to select a desired call request. The gesture-based systems also provide a more energy efficient user interface 10 that may power down or enter a "rest" mode after a certain period of activity. Further, the gesture-based systems provide an enhanced human-elevator system interaction experience through real-time interaction with the user, and provides a more ergonomic and intuitive user interface for call requests in a multi-axis, multi-car, multi-route elevator system. By using a gesture-based user interface 10, a scalable solution is provided to the increasingly complex car requests for a multi-axis, multi-car, multi-route elevator system. The gesture-based system may also be complimented with a touch-screen display on the user interface 10 to augment the user's experience. Lastly, using the gesture-based system improves hygiene around the public space of the elevator system, which provides a more sanitary public space.

It is to be understood that all of the program instructions described above for the user interface 10 may be provided on a non-transient computer readable medium to be used with the user interface 10 to perform the particular display methods and operations described above.

While various aspects of the elevator system 12 and the user interface 10 and methods of operating the user interface 10 were provided in the foregoing description, those skilled in the art may make modifications and alterations to these aspects without departing from the scope and spirit of the disclosure. For example, it is to be understood that this disclosure contemplates that, to the extent possible, one or more features of any aspect may be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An elevator control system for a multi-axis elevator system including at least one elevator car that moves throughout a building, comprising:

a display device;

at least one processor in communication with the display device and the elevator system, the at least one processor programmed or configured to:

render, on the display device, a graphical destination interface comprising a plurality of visual representations of destinations within the building;

receive a user selection of a selected destination from the plurality of destinations;

determine a plurality of selectable options for elevator call requests based on the selected destination;

render the plurality of selectable options for elevator call requests on the graphical destination interface or a second graphical call request interface;

receive a user selection of a selected option from the plurality of selectable options for elevator call requests; and control movement of an elevator car in the elevator system based on the selected destination and the selected option.

2. The elevator control system as claimed in claim 1, wherein the elevator car is controlled by transmitting at least one control signal to at least one of the following: an elevator car controller, a master controller, a remote server, or any combination thereof.

3. The elevator control system as claimed in claim 1, wherein the graphical destination interface comprises an isometric rendering of at least a portion of the building, the three-dimensional rendering comprising the plurality of destinations.

4. The elevator control system as claimed in claim 1, wherein the elevator call request options for user selection are rendered on the second graphical call request interface.

5. The elevator control system as claimed in claim 4, wherein the elevator call request options include at least two of the following: a shortest route in distance traveled to a final destination, a route with the shortest time to destination (ETD), a route that departs the quickest or has the quickest estimated time of arrival (ETA), a route with the shortest riding time, a most popular route to the final destination, a least crowded route to the final destination, a route with fewest direction changes, a route with a lowest energy consumption, a route customized for a specific building, company, individual, or group of individuals, or any combination thereof.

6. The elevator control system as claimed in claim 4, wherein the elevator call request options include at least two different elevator car options for user selection.

7. The elevator control system as claimed in claim 6, wherein each elevator car option displays at least one of the following: an occupancy of the elevator car, an estimated time to a final destination chosen by the user, and an estimated time of arrival for the elevator car.

8. The elevator control system as claimed in claim 1, further comprising a gesture-based control system in communication with the at least one processor, and wherein the gesture-based control system is configured to permit the user to select the elevator call request based on gestures made by the user.

9. The elevator control system as claimed in claim 8, wherein the gesture-based control system comprises at least one motion sensor configured to track the gestures made by the user.

10. The elevator control system as claimed in claim 9, wherein the motion sensor tracks the gestures made by the user based on the motion of a wearable device worn by the user relative to the motion sensor.

11. The elevator control system as claimed in claim 1, further comprising a vision-based control system in communication with the at least one processor, and wherein the vision-based control system is configured to permit the user to select the elevator call request based on motions made by the user.

12. The elevator control system as claimed in claim 11, wherein the vision-based control system comprises one of the following to track the gestures made by the user: a stereo camera, a proximity sensor, and an infrared depth sensor.

13. A computer-implemented method for controlling an elevator car in a multi-axis elevator system that permits movement of the elevator car throughout a building, comprising:

rendering, on a display device, a graphical destination interface comprising a visual representation of at least a portion of the elevator system including a plurality of destinations within the building;

receiving, from an input device, a selected destination from the plurality of destinations;

determining, with at least one processor, a plurality of route options or elevator car options available for a user to choose from;

rendering, on the display device, the plurality of route options or elevator car options;

receiving, from the input device, a selected route option or elevator car option from the plurality of route options or elevator car options; and controlling, with at least one processor, movement of the elevator car based on the selected route option or elevator car option.

14. The method as claimed in claim 13, wherein the route options or elevator car options for user selection are displayed on the graphical destination interface or a graphical call request interface.

15. The method as claimed in claim 13, wherein the route options include at least two of the following: a shortest route in distance traveled to a final destination, a route with the shortest time to destination (ETD), a route that departs the quickest or has the quickest estimated time of arrival (ETA), a route with the shortest riding time, a most popular route to the final destination, a least crowded route to the final destination, a route with fewest direction changes, a route with a lowest energy consumption, a route customized for a specific building, company, individual, or group of individuals, or any combination thereof.

16. The method as claimed in claim 13, wherein each elevator car option displays at least one of the following: an occupancy of the elevator car, an estimated time to a final destination for the elevator car or route (ETD), an estimated time of arrival for the elevator car, or any combination thereof.

17. The method as claimed in claim 13, wherein one of the route options or the elevator car options is selected by a gesture made by a user.

18. The method as claimed in claim 13, wherein the visual representation of at least a portion of the elevator system is manipulated by the user to allow the user to select the destination from the plurality of destinations.

19. The method as claimed in claim 18, wherein the user manipulates the visual representation of at least a portion of the elevator system using one of the following: gestures made in front of the display device, pinching the visual representation, pressing the visual representation, tapping the visual representation, or any combination thereof.

20. A computer program product for controlling a multi-axis elevator system that permits movement of at least one elevator car throughout a building, comprising at least one non-transitory computer-readable medium including program instructions that, when executed by at least one processor, cause the at least one processor to:

render, on a display device, a graphical destination interface comprising a visual representation of at least a portion of the elevator system including a plurality of destinations within the building;

receive, from an input device, a selected destination from the plurality of destinations;

determine, with at least one processor, a plurality of route options or elevator car options available for a user to choose from;

render, on the display device, the plurality of route options or elevator car options;

receive, from the input device, a selected route option or elevator car option from the plurality of route options or elevator car options; and control, with at least one processor, movement of the elevator car based on the selected route option or elevator car option.

* * * * *